US006257540B1

(12) United States Patent
Kresch

(10) Patent No.: US 6,257,540 B1
(45) Date of Patent: Jul. 10, 2001

(54) METHOD FOR STORING FRESH FRUITS AND VEGETABLES

(76) Inventor: Gloria Kresch, 1632 Mt. Pleasant Rd., Havertown, PA (US) 19083

( * ) Notice: Subject to any disclaimer, the term of this patent is extended or adjusted under 35 U.S.C. 154(b) by 0 days.

(21) Appl. No.: 09/474,223

(22) Filed: Dec. 29, 1999

Related U.S. Application Data

(63) Continuation-in-part of application No. 09/157,902, filed on Sep. 21, 1998, now abandoned.

(51) Int. Cl.[7] ..... A47B 91/00
(52) U.S. Cl. ..... 248/346.01
(58) Field of Search ..... 248/346.01, 346.11, 248/346.4, 346.5

(56) References Cited

U.S. PATENT DOCUMENTS

| | | | | |
|---|---|---|---|---|
| 186,929 | * | 2/1877 | Hamilton | 220/572 |
| 347,665 | * | 8/1886 | Vail | 220/572 |
| 423,740 | * | 3/1890 | Coons | 220/572 |
| 539,698 | * | 5/1895 | Milligan | 248/346.11 |
| 718,517 | * | 1/1903 | Perry | 248/346.11 |
| 1,017,455 | * | 2/1912 | Otto | 220/572 |
| 1,161,727 | * | 11/1915 | Randall | 134/182 |
| 2,128,118 | * | 8/1938 | Burford | 248/346.11 |
| 2,575,843 | * | 11/1951 | Semrow | 312/351 |
| 3,040,897 | * | 6/1962 | Holman | 210/244 |
| 5,687,444 | * | 11/1997 | Hakker | 15/104.92 |

* cited by examiner

*Primary Examiner*—Ramon O. Ramirez

(57) ABSTRACT

The invention is a method that uses a separator that is transferable, washable, and fits into containers of various sizes, to enhance storing fruits and vegetables in a container, prolonging the freshness of the stored fruits and vegetables. By placing the fruits or vegetables on a separator in a container, spoilage in the fruits and vegetables is reduced by minimizing contact of the fruits and vegetables with water in bottom of container. Furthermore, humidity is maintained in container, such as by covering the container, retaining the humidity and moisture in the fruits and vegetables so that the fruits or vegetable stay crisp and fresh. The separator comprises a base having a plurality of cleats projecting above and below the base to support a fresh fruit or vegetable within a container. The projecting cleats prevent the fruit or vegetable from coming in contact with water which may be present in the container thereby reducing spoilage. The base and cleats are preferably comprised of an elastomeric material to allow the base and the cleats to deform under the weight of a fruit or vegetable to allow the spreading of the load to additional cleats, thereby reducing the likelihood of puncturing of the fruit or vegetable by the cleats.

9 Claims, 3 Drawing Sheets

METHOD FOR STORING FRESH FRUITS AND VEGETABLES

This application is a continuation-in-part of Ser. No. 09/157,902 filed on Sep. 21, 1998, now abandoned.

BACKGROUND OF THE INVENTION

1. Field of Invention

The invention relates to separator and a method using a separator for storing fresh fruits and vegetables. The separator supports the fruit and vegetables within a suitable environment in a container, so that the fruits and vegetables retain their moisture without coming in contact with water in the bottom of the container, thereby reducing spoilage and keeping fruit and vegetables fresh and crisp.

2. Description of Related Art

By their nature, fresh fruits and vegetables are highly perishable. The tendency of fresh fruits and vegetables to spoil is increased by contact with water. In recent years, retail customers have become more aware of the dangers poised by pesticide residues and of the need to carefully remove the residues. The resulting washing exposes the fruits and vegetables to water. Subsequent storage of the wet fruits and vegetables promotes spoilage if they are stored in contact with residue water from washing which tends to collect in the bottoms of containers.

Although contact with water promotes spoilage, the absence of water is also detrimental to certain fresh fruits and vegetables, particularly to lettuce and other vegetables that lack a relatively impervious outer skin. The absence of water results in the fruit or vegetable becoming desiccated and as not being "fresh." To avoid desiccation, it is desirable to maintain fruits and vegetables in an environment of high humidity, as in a closed plastic bag, or any container that comes with a top or that can be covered with plastic wrap, which are readily available in many stores.

The present invention uses an article for separating the fresh fruit or vegetables from the bottom of its container. The invention prevents contact between the fruit or vegetable with water in the container, while allowing circulation of high-humidity air. The result is that spoilage is reduced, while freshness or the fruit or vegetable is maintained.

The prior art contains various devices to drain water from objects. An example is the familiar soap dish, with raised members to hold a bar of soap above the surface of water drained from soap. See U.S. Pat. No. 2,575,843 to H. Semrow, issued Mar. 14, 1946.

Other examples include dish drainers, as in U.S. Pat. No. 1,017,455 to A. Otto, issued Feb. 13, 1912; U.S. Pat. No. 347,665 to M. Vail issued Aug. 17, 1886 and U.S. Pat. No. 423,740 to C. Koons issued Mar. 18, 1890.

Prior art teaches using a soap holder to dry soap in the open air, and specifically teaches the necessary aspect of drying the moisture in the soap. Indeed, soap gets soggy and difficult to use in a humid environment. The current method uses a similar separator in a method that keeps the moisture in the fruits and vegetables so that such moisture will keep such fruits and vegetables fresh longer. The primary function in prior art is draining water in order to promote drying of the objects. The method shown in this invention calls for separation of fruits or vegetables from direct contact with water in bottom of container, while retaining the humidity and moisture in the fruit and vegetables, rather than drying them.

In addition to the notion that fruits and vegetables stay crisp and fresh under humid environment, a positive environment for them, bacteria and rot damage is hindered when using the separator and keeping any water that collects in the bottom of the container away from the fruits and vegetables. The separation of fruits and vegetables from such standing water that collects in the bottom of the container prevents such bacteria and other rot producing agents from contaminating the fruits and vegetables and prolongs their freshness.

The prior art does not teach or suggest the use of a separator having raised cleats to separate fresh fruits and vegetables from water in containers to reduce spoilage of the fruits and vegetables. The prior art does not teach or suggest the use of elastomeric materials for the cleats or base of a separator to spread the weight of a relatively heavy fruit or vegetable among additional cleats to prevent bruising or puncturing of the fruit or vegetable. The prior art does not teach or suggest the use of cleats of varying lengths to support fruits or vegetables of different weights while preventing damage to the fruits or vegetables.

The prior art does not teach the use of a portable separator that can accommodate various size containers and can be transferred into various size containers, such separator is easily washable, and used to keeps fruits and vegetables fresh.

SUMMARY OF INVENTION

It is the object of the present invention to provide a separator and a method using a separator which allows storage of fruit or vegetables in a container while preventing contact between the fruit and vegetables and water which may be present in the bottom of the container, while retaining a humid environment for the fruits and vegetables so they would stay fresh and crisp.

Normally, we wash fruits and vegetables, allow them to be drained of the water, and then keep them in the refrigerator in plastic bags or containers, some closed with a lid or plastic wrap. Some water tends to collect in the bottom of the container from continued drainage over time. This water tends to promote some adverse conditions on the bottom layer of the fruits and vegetables, such as rot or spoilage. This residue of water at the bottom of the container provides a bed for bacteria to grow which can then be in contact with the fruit or vegetables resting in it, resulting in contamination or spoilage.

Under this invention, washed fruits or vegetables are placed on top of a separator inside a container. This separator, while supporting fruits or vegetables, allows residue water to continue to drain into the container, but such water is kept separated from the fruit and vegetables. The fruits and vegetables, resting on the separator within the container, are stored, preferably covered, in a suitable environment, such as a refrigerator. The high-humidity air allows fruits or vegetables to stay crisp, while spoilage is reduced, due to lack of contact with direct water in the bottom of the container.

The invention is a method for keeping fresh fruits or vegetables crisp and fresh, using a separator. Such separator rests on the bottom of a container in which one wishes to store fresh fruits or vegetables. Fruits or vegetables, preferably washed, are placed inside the container, on top of the separator. For best results, place fruits or vegetables in such a way as to allow as much of the residue water to drain out of them as they are placed on top of the separator. For example: In the case of lettuce, it would be best to set the open area near the cut-out stem of the lettuce on the bottom touching the upper cleats of the separator, so any residue water collected in the leaves can drain down into the bottom of the container. Washing fruits or vegetables, in addition to removing pesticides, dirt, and bacteria, also exposes the various surfaces of the fruits and vegetables to water that replenishes any desiccation or wilting that has occurred by the transport of the fruit and vegetables from harvest to home. However, we wish to drain such water as well as we can, and store such fruits or vegetables without direct contact with water, to minimize rot.

We then create a humid environment by creating a closed environment, such as by covering the container. The air inside the closed container becomes humid, since evaporation that results from the water molecules leaving the various surfaces of the fruits and vegetables has little or no exit outside the container, therefore is not lost from this closed environment. The humid air helps keep the fresh fruits and vegetables crisp and fresh. The reason the humid environment is helpful to keep fresh fruits or vegetables fresh is that water from fruits or vegetables is lost much more slowly into air already laden with water vapor, so the fruits and vegetables hold their crispness, turgidity, much more readily in an environment that does not promote much evaporation by the fruits or vegetables. Another reason why such closed humid environment works well to keep fruits or vegetables crisp and fresh is that while in the open air, the current of the air blows away water vapor that has accumulated on the surface of the fruits or vegetables, therefore accelerates the rate of evaporation from such surfaces. No such process occurs in the closed humid environment. In the closed environment, no such breeze takes place, and this helps minimize evaporation of water from fruits or vegetables. Any evaporation that does occur, stays in the closed container, and aids the process of reducing further evaporation from the fruits or vegetables. The method using a separator as described in this invention, exposes maximal surface of the fruits or vegetables to the humid air, allowing all the benefits explained in this method to apply to maximal areas of the fruits of vegetables, therefore, retaining their maximal freshness. The construction of the separator is such that it allows maximal contact of fresh fruits and vegetables with the humid air inside the container.

The next step in this method requires that we place the closed container in an appropriate environment. Such environment is a cool environment, as we normally do with fruits or vegetables, such as a refrigerator. The cool environment in which the container is placed causes the pores on the surfaces and elsewhere in the fruits or vegetables to close, and such narrowing of the openings helps retain the moisture already in the fruits or vegetables, and evaporation of moisture from the fruit or vegetables is minimized. This helps keep fruits or vegetables crisp and fresh. Any loss of water from such fruits or vegetables that does occur due to evaporation, is readily replenished in the humid environment, due to the fact that the environment is laden with water vapor. Colder temperatures also minimize rot, since organisms flourish less in colder environments, thus reducing spoilage in the fruits or vegetables. Bacteria is also reduced in the collecting residue water in the bottom on the container, where bacteria will tend to grow. The separator keeps the fruits or vegetables from direct contact with such water, therefore minimizing rot that may be caused by such contact.

As can be seen, the maintained humid environment provides benefits which prevent wilting by minimizing loss of moisture from the fruits or vegetables, and by replenishing any loss that does occur, thus maintaining freshness in the fruits or vegetables. The method of this invention, using a separator, aids this process by exposing a maximal surface of the fruits or vegetables to the air circulating inside the container and thus allowing maximal benefits to surfaces of fruits or vegetables and thus allowing their freshness and crispness to be maintained. Furthermore, the separator helps prevent the collecting residue water at the bottom of the container from direct contact with the fruits or vegetables, thus minimizing incidence of rot that may occur as a result of direct contact with residue water where bacteria may tend to grow.

For best results, a tightly fitted cover can be used, such as a fitting lid over a pot, or a plastic lid over a container. Where the container does not have a properly tight-fitting cover, or if fruits or vegetables raise above the height of the container when placed therein, a commonly used plastic wrap can serve as a cover. Such plastic wrap goes over the top of container, and clings to the sides of said container.

There are other ways to create a humid environment to store fresh fruits or vegetables. Similar results of maintaining a high humid environment to keep freshness in fruits or vegetables can be achieved by placing the separator in a plastic bag, where the plastic bag acts as a container, and placing fruits or vegetables on top of such separator. Such plastic bag can be closed to create the humid conditions needed, and placed in a cool place. The conditions for maintaining high humidity occur by the same principles as explained above, and the separation from the water at the bottom of the bag will reduce spoilage of fruits or vegetables. Other uses may be utilized for such a method and use of such separator where high humidity is utilized to achieve a benefit, and where drainage is required to maximize benefit.

The separator can also be used in the washing phase of preparing the fruits or vegetables for storage. By placing the separator in an empty container, then placing the fruits or vegetables on top of such separator, one can fill container with water and wash the fruits or vegetables therein. Subsequently, one tilts container to discard water while at the same time holding hand over fruits or vegetables, so they won't fall out. After water drains, one restores container to upright position. Fruits or vegetables are now washed, already placed on top of a separator, in a container, and are ready to be stored. Preferably, container is covered and stored in refrigerator.

It is a further object of the invention to minimize the surface area of the fruit or vegetable in contact with the separator while avoiding bruising or puncturing of the fruit of vegetable by the separator. Under this invention, we rest the fruits and vegetables on a separator, which allows air to circulate at the area where the fruits and vegetables are resting, and minimizes the contact with separator surface area so fruit and vegetables stay free to absorb the humidity in the air. This method maximizes the air flow within a humid environment.

It is a further object of the present invention to support fruits and vegetables of different relative weights while accomplishing the foregoing objects.

Furthermore, the invention maximizes drainage of residue water from the base of the separator. Moisture that is trapped in flat areas in the base tend to form mildew and rot. The invention allows for drainage to occur smoothly and continuously.

It is still a further object of the present invention to make invention sanitary to use, by constructing the separator from materials having a slippery or non-stick surface to facilitate cleaning. The elastomeric material allows bending the article so the washing the areas between cleats becomes easy, and any mildew that may begin to accumulate can be easily reached and removed.

By constructing the separator from elastomeric material, the separator can easily fit in various size containers, since exact fit is not necessary as in the case of rigid construction. Separator can be made in various sizes and shapes as well to address various needs.

Using the invention proposed here, we create a separation between the water that collects at the bottom of the container and the fruits or vegetables stored therein. This separation maintains crispness in the fruits and vegetables and prolongs time that fruits and vegetables can be used by the consumer without spoilage. For example, lettuce can last three or more weeks if the separator is used in the container holding the lettuce. Without the separator, the lettuce will form a pink discoloration that will start within a few days from the washing of the lettuce. No pink growth forms with the use of the separator.

The foregoing objects are accomplished by using a separator similar to the description as follows. The separator comprises a base having plurality of cleats projecting above the base to support a fruit or vegetables within the container. The projecting cleats allow circulation of air under the fruits or vegetables and will also prevent the fruit or vegetables from coming in contact with water which may be present in the container thereby reducing spoilage. At the same time, the fruits or vegetables retain their moisture in the humid environment and thus increase crispness and freshness. The cleats may have rounded tips thereby facilitating use of the separator with a plastic bag without puncturing the bag. The use of cleats allows various size fruits and vegetables to rest on top of the separator so that air circulates without any of the holes in the base facilitating drainage being blocked The separator may be provided with cleats projecting downwardly from the base to hold the base above the surface of the container. Downwardly projecting cleats prevent the base from coming in contact with any water which may be present in the container. These cleats will have to support the base so it won't buckle under the weight of the fruits and vegetables. The cleats which act like supporting legs may or may not be identical to the cleats project upwardly.

The separator may be provided with cleats of an elastomeric material, such as vinyl plastic, to allow deformation of the cleats under the weight of a relatively heavy fruit or vegetable. Deformation of the cleats allows additional cleats to come in contact with the relatively heavy fruit or vegetable, spreading the weight of the fruit or vegetable among more cleats to prevent bruising or puncturing of the fruit or vegetable.

The separator may be provided with a combination of upwardly and downwardly projecting cleats of varying lengths and with cleats and base composed of an elastomeric material. Fruits and vegetables of a wide range of relative weights may thus be supported within a container while preventing contact with any water in the container and without bruising or puncturing the fruits and vegetables.

DESCRIPTION OF THE PREFERRED EMBODIMENT

Figure 1:
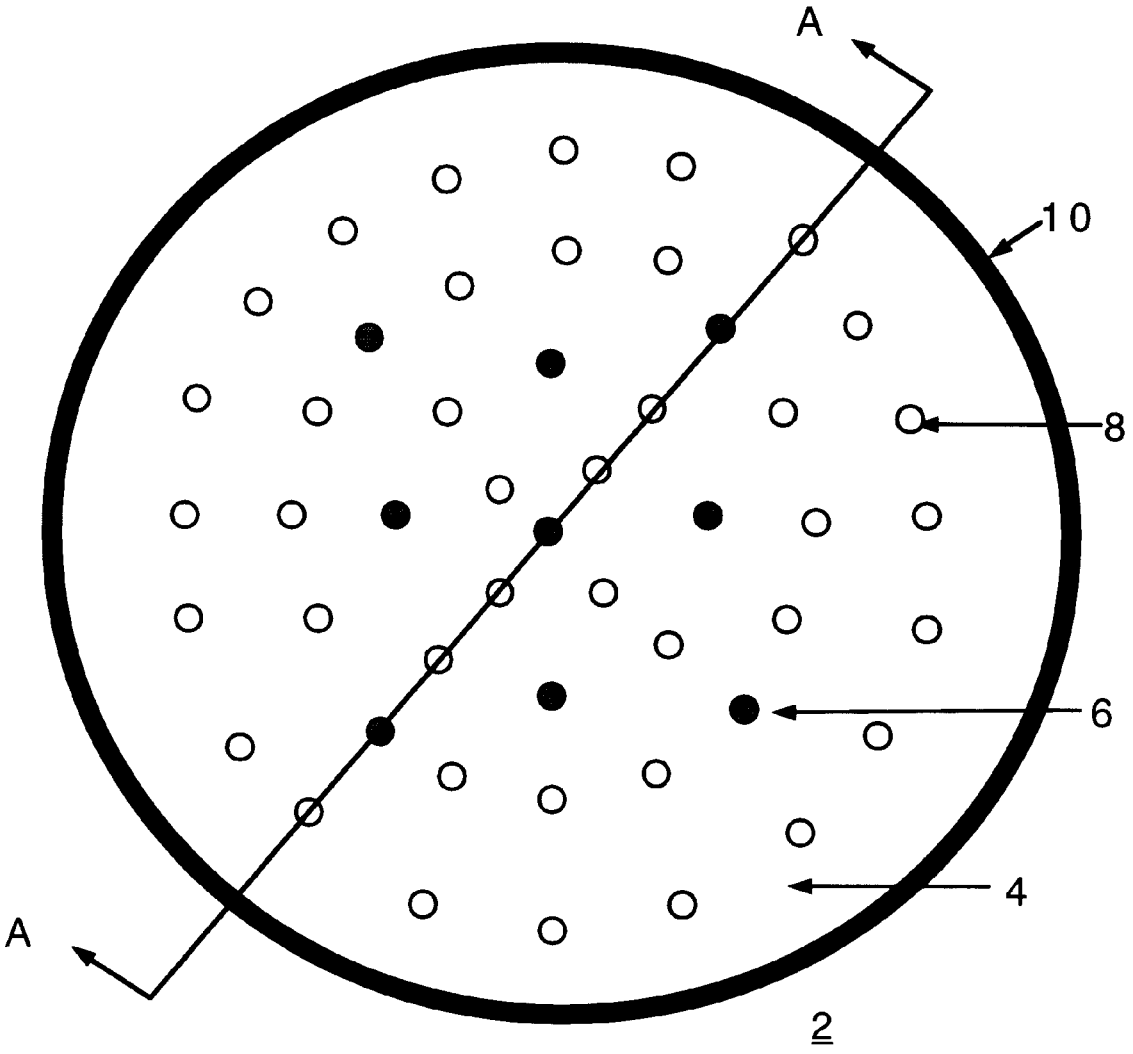
FIG. 1 is a plan view of the separator.

As shown in FIG. 1, the preferred embodiment of the separator 2 comprises a base 4 having drain holes 6, upwardly projecting cleats 8 and a reinforcing ring 10. The number, size and spacing of the upwardly projecting cleats 8 are selected so as to adequately support the fruit or vegetable without puncturing or bruising and while minimizing the surface of the cleat 8 in contact with the fruit or vegetable.

Figure 2:
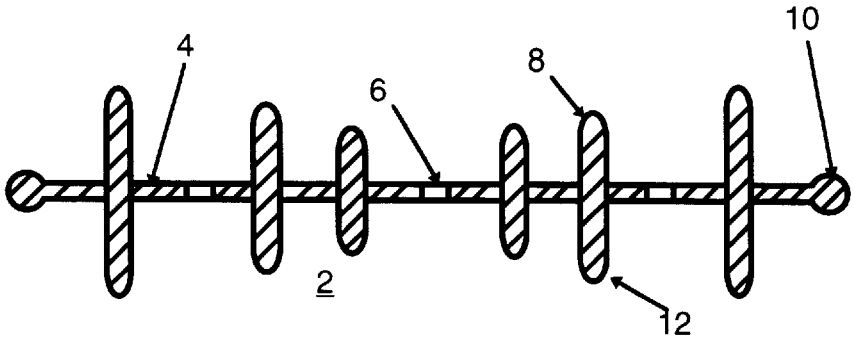
FIG. 2 is a view of the separator in FIG. 1 taken along line A—A, with some details excluded for clarity.
Figure 3:
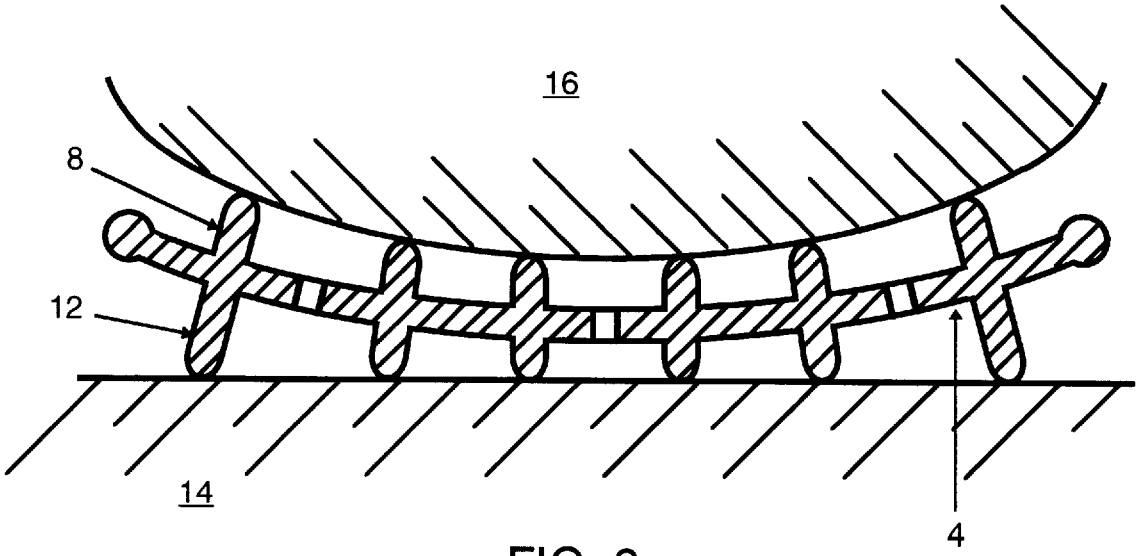
FIG. 3 is Section A—A of the separator showing a supported fruit or vegetable and showing the supporting surface of the container.
Figure 3A:
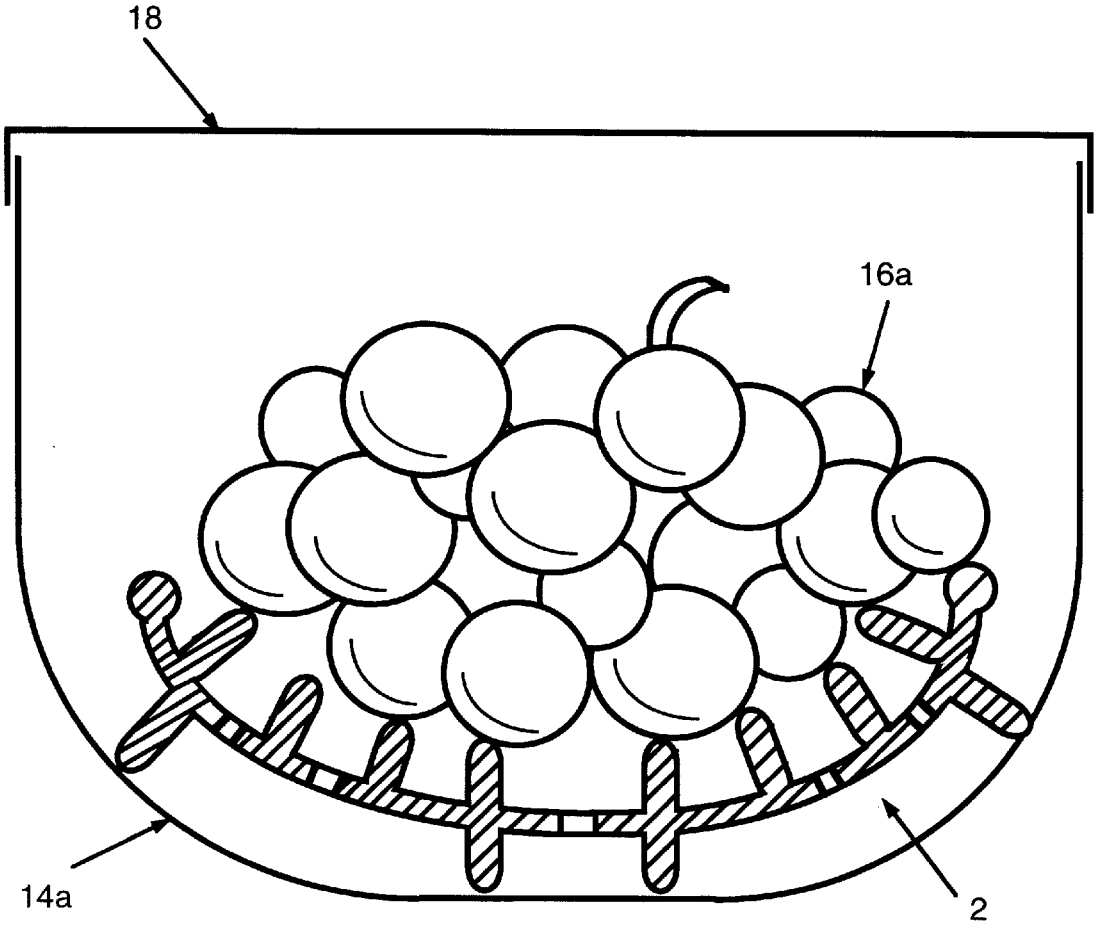
FIG. 3*a* is same section as FIG. 3. Container has a curved base, and separator accommodates such base, and fruits or vegetables are shown supported by separator in a closed container.

As illustrated in FIG. 3, the separator 2 is placed in a container 14, one or more fruits or vegetables 16 are placed on the separator 2 and the container 14 is closed. FIG. 3*a* illustrates a similar situation. However, the base of the container 14*a* is curved, reflecting the adjustment of separator 2 to various shapes and sizes of containers, and where the fruits or vegetables 16*a* are placed in a container with a cover 18, and such container is placed in a suitable cool environment. As illustrated by FIGS. 2 and 3, in the preferred embodiment downwardly projecting cleats 12 support the base 4 above the container 14. The use of both downwardly and upwardly projecting cleats 8, 12 reduces the amount of surface area of the separator 2 in contact with water in the container 14, and minimizes contact with the fruit or vegetable being supported.

Although the upwardly cleats, and the downwardly cleats do not have to be similar in size or number, and will have to be determined based on optimal design of support and separation of fruits and vegetables as deemed desirable, a particular case shown here assumes that both downwardly and upwardly projecting cleats 8, 12 allow the separator 2 to be substantially symmetrical and more convenient for the user in that either side of the separator 2 may be placed in contact with the container 14 and either side may be placed in contact with the fruit or vegetable 16.

In the preferred embodiment and as illustrated by FIG. 2, the projection of the cleats 8, 12 above and below the base 4 is greatest at the periphery of the base 4 and least at its center. The use of cleats 8, 12 of varying lengths allows the separator 2 to conform more closely to the rounded shapes of fruits or vegetables placed on the separator and to thereby reduce bruising caused by support of a heave fruit or vegetable on only a few cleats.

In the preferred embodiment, the cleats 8, 12 are comprised of an elastomeric material, such as vinyl plastic. The use of an elastomeric material allows the cleats to deform under the weight of a fruit or vegetable to be spread among more cleats, thereby reducing bruising.

In the preferred embodiment, the base 4 is comprised of an elastomeric material, such as a vinyl plastic. The use of the elastomeric material for the base 4 in combination with cleats 8, 12 of different lengths as shown on FIG. 3 allows the base 4 to deform under the weight of a heavy fruit or vegetable 16. The deformation beings more upwardly projecting cleats 8 to bear to support the fruit or vegetable 16, thereby reducing bruising caused by supporting the weight of the fruit or vegetable 16 on only a few cleats 8. The deformation of the base 4 also changes the aspect of the cleats 8, 12, as shown by FIG. 3. Under the weight of a heavy fruit or vegetable 16, the deformation of the base 4 causes the cleats to carry the load as a compressive force along the long dimension of the cleat 8, 12, thereby increasing the load that each individual cleat 8, 12 can support. The range of weights of fruits or vegetables 16 which can be accommodated by the separator 2 is thus increased.

Figure 2A:
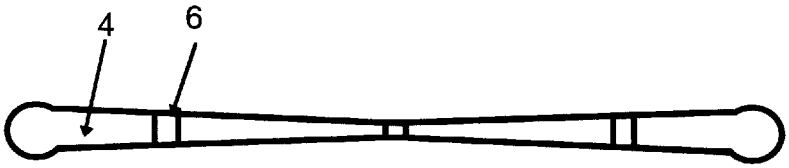
FIG. 2*a* shows another embodiment of the base shown in FIGS. 1 and 2.

In an alternate embodiment of the invention shown in FIG. 2*a* the base 4 of the invention is thicker at its periphery that at its center. This serves to direct excess water to flow towards holes 6.

The upwardly projecting and downwardly projecting cleats minimize contact between the fruit or vegetable being supported by the separator and provide a space or gap between the bottom of the fruit or vegetable being separated and the bottom of the container. This separation permits water to drain from the supported fruit or vegetable and collect in the bottom of the container and prevents the supported fruit and vegetable from being immersed in the drained water. Additionally, air is permitted to circulate between the bottom of the supported fruit or vegetable and the surface of the drained water or the bottom of the container, as applicable.

Although FIG. 1 depicts the separator 2 and its base 4 as circular the preferred embodiment of the invention may be circular, oval, square shaped or any desired shape. The particular shape may be influenced by the container it is to be used in conjunction with or be a variety of other factors including the weight or shape of the particular fruit or vegetable being separated. The same separator can be used in containers of various sizes and is portable.

In the preferred embodiment, the separator 2 is provided with or inherently has a slick or slippery surface finish to assist in cleaning of the separator between uses. In the preferred embodiment, the separator is case or injection molded as a single piece.

Although the invention has been described with reference to the preferred embodiments, workers skilled in the art to which the invention pertains will recognize that changes may be made in form and detail without departing from the spirit and scope of the invention.

What is claimed is:

1. A method using a separator for storing fruits or vegetables comprising the steps of:

a. resting the separator inside a container, b. resting the fruits or vegetables on said separator, c. means for maintaining high humidity inside the container, and d. storing the container in a suitable environment, wherein humidity which is maintained inside the container keeps the fruits or vegetables fresh, and the separation of the fruits or vegetables from direct contact with any water collecting in the bottom of the container minimizes spoilage of fruits or vegetables.

2. The method of claim 1 wherein the separator is:

a. portable, b. transferable, c. constructed of an elastomeric material to allow flexibility and bending of said separator, wherein said separator can bend and deform so as to be accommodated to containers of various sizes and shapes.

3. The method of claim 1 wherein the separator comprises:

a. a base having a center, a periphery, a first or upper side, and a second or lower side, b. a plurality of holes passing through said base from the upper side to the lower side, wherein water is permitted to pass from the upper side to the lower side, so as to be collected in the container.

4. The method of claim 3 wherein separator further comprises:

a. a plurality of elongated lower cleats, b. said lower cleats being affixed to and projecting downwardly from the lower side of the base of said separator, wherein said lower cleats support said separator, thereby separating said base and any fruit or vegetables supported above said base from the water at the bottom of the container.

5. The method of claim 4 wherein the separator further comprises:

a. a plurality of elongated upper cleats, b. said upper cleats being affixed to and projecting upwardly from the upper side of the base of said separator, wherein said upper cleats support fruits and vegetables and separate them from said separator and permit the bottom of the fruits or vegetables to be exposed to air, thereby maximizing air flow around fruits or vegetables.

6. The method of claim 5 wherein the separator further comprises:

a. a base of an elastomeric material which deforms easily under the weight of the fruits or vegetables, b. said upper and lower cleats which adjust to the shape and weight of the fruits or vegetables, wherein said separator can deform under the weight of the fruits or vegetables, thereby allowing said separator to be used with a variety of fruits or vegetables such that the upper cleats in contact with and supporting the fruits or vegetables do not puncture or bruise the fruits or vegetables.

7. The method of claim 6 wherein:

a. the base varies in thickness as a function of the distance from the center of said base, such that it is thickest at its periphery and thinnest at its center, and b. the length of said cleats varies as a function of the cleat's distance from the center of the base such that cleats adjacent to the periphery are of greater length than are cleats adjacent to the center, wherein the base can deform under the weight of fruits or vegetables, thereby permitting proper drainage.

8. The method of claim 6 wherein the deformation or bending of said base and cleats provides for easy access to all areas of said separator, and said separator can be easily scrubbed or cleaned for sanitary purposes.

9. The method of claim 6 wherein the base varies in thickness as a function of the distance from the center of said base, such that it is thickest at its periphery and thinnest at its center, wherein the thicker periphery of said base acts as a reinforcing ring to provide structural support to the base.

* * * * *

UNITED STATES PATENT AND TRADEMARK OFFICE

CERTIFICATE OF CORRECTION

PATENT NO. : 6,257,540 B1
DATED : July 10, 2001
INVENTOR(S) : Gloria Kresch

It is certified that error appears in the above-identified patent and that said Letters Patent is hereby corrected as shown below:

Column 7,
Line 46, insert -- providing -- before "means"

Signed and Sealed this

Sixteenth Day of April, 2002

*Attest:*

*Attesting Officer*

JAMES E. ROGAN
*Director of the United States Patent and Trademark Office*